US008061271B2

(12) United States Patent
Murray et al.

(10) Patent No.: US 8,061,271 B2
(45) Date of Patent: Nov. 22, 2011

(54) PROGRAMMABLE INERTIAL IGNITERS FOR GUN-FIRED MUNITIONS, THERMAL BATTERIES AND THE LIKE

(75) Inventors: Richard T. Murray, Brentwood, NY (US); Jahangir S. Rastegar, Stony Brook, NY (US); Thomas Spinelli, East Northport, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 657 days.

(21) Appl. No.: 12/079,164

(22) Filed: Mar. 25, 2008

(65) Prior Publication Data

US 2011/0252994 A1 Oct. 20, 2011

(51) Int. Cl.
*F42C 19/06* (2006.01)

(52) U.S. Cl. ..... 102/216; 102/247; 102/248; 102/251; 102/272

(58) Field of Classification Search ..... 102/216, 102/247, 248, 251, 272, 204
See application file for complete search history.

(56) References Cited

U.S. PATENT DOCUMENTS 4,144,816 A * 3/1979 Beuchat ..... 102/251
4,949,639 A * 8/1990 Burns ..... 102/249
7,587,979 B2 * 9/2009 Rastegar et al. ..... 102/247

* cited by examiner

*Primary Examiner* — J. Woodrow Eldred

(57) ABSTRACT

An inertial igniter including: a housing; a striker mass movable relative to the housing; a biasing element for biasing the striker mass towards a percussion primer; one or more movable members each having one or more stops, the one or more stops having a first position for preventing a portion of the striker mass from striking the percussion primer and a second position allowing the portion of the striker mass to strike the percussion primer; wherein the movable members move the one or more stops to the second position when subjected to a predetermined acceleration profile.

21 Claims, 4 Drawing Sheets

PROGRAMMABLE INERTIAL IGNITERS FOR GUN-FIRED MUNITIONS, THERMAL BATTERIES AND THE LIKE

BACKGROUND

1. Field of the Invention

The present invention relates generally to acceleration (deceleration) operated inertial igniters for use in gun-fired munitions, and more particularly for inertial igniters for thermal batteries used in gun-fired munitions and other similar applications that are readily programmed to initiate at a desired acceleration level.

2. Prior Art

Thermal batteries represent a class of reserve batteries that operate at high temperatures. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniters operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operate based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low impact levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

In recent years, new improved chemistries and manufacturing processes have been developed that promise the development of lower cost and higher performance thermal batteries that could be produced in various shapes and sizes, including their small and miniaturized versions. However, the existing inertial igniters are relatively large and not suitable for small and low power thermal batteries, particularly those that are being developed for use in miniaturized fuzing, future smart munitions, and other similar applications.

The need to differentiate accidental and initiation accelerations by the resulting impulse level of the event necessitates the employment of a safety system which is capable of allowing initiation of the igniter only during high total impulse levels.

SUMMARY

A need therefore exists for the development of a novel method and resulting inertial igniters for thermal batteries used in gun fired munitions, particularly for small and low power thermal batteries that could be used in fuzing and other similar applications that occupy small volumes, eliminate the need for external power sources, and can be "programmed" to satisfy various all-fire acceleration requirements, and therefore make it possible to provide low cost inertial igniter solutions for the varieties of gun-fired munitions and other similar applications.

Accordingly, an inertial igniter is provided. The inertial igniter comprises: a housing; a striker mass movable relative to the housing; a biasing element for biasing the striker mass towards a percussion primer; one or more movable members each having one or more stops, the one or more stops having a first position for preventing a portion of the striker mass from striking the percussion primer and a second position allowing the portion of the striker mass to strike the percussion primer; wherein the movable members move the one or more stops to the second position when subjected to a predetermined acceleration profile.

The striker mass, biasing element and one or more movable members can be configured as a sub-assembly contained within the housing. The housing can include a cut-out portion corresponding to each of the one or more movable members and the one or more movable members move into the cut-out portion when the one or more stops assume the second position.

The portion of the striker mass that strikes the percussion primer can be a protrusion from a surface of the striker mass.

The biasing member can be a compression spring.

The one or more movable members can be pivotal about a pivot relative to a base member. The pivot can be a living hinge which is plastically deformed upon being subjected to the predetermined acceleration profile. The one or more stops can be positioned at an end of the movable member opposite from the pivot.

The striker mass can have a portion which engages a portion of the one or more arms when subjected to the predetermined acceleration profile to urge the one or more stops into the second portion.

The inertial igniter can further comprise a programming means for varying the predetermined acceleration profile at which the sticker mass strikes the percussion primer. The programming means can comprise one or more programming biasing members. The one or more programming biasing members can comprise one or more spring bands. The housing can comprise one or more grooves for accommodating the one or more spring bands. The one or more grooves can comprise a plurality of grooves each at a different location on the housing. The one or more spring bands can be one of plastically deformed, broken or released upon being subjected to the predetermined acceleration profile.

Also provided is a method for striking a percussion primer upon a predetermined acceleration profile. The method comprising: blocking a striker mass from striking the percussion primer with one or more stops when an applied acceleration and duration is less than the predetermined acceleration profile; and removing the one or more stops as obstacle to the striker mass striking the percussion primer when the applied acceleration and duration is greater than the predetermined acceleration profile.

The removing step can comprise deforming a movable member which holds the one or more stops when the applied acceleration and duration is greater than the predetermined acceleration profile.

The method can further comprise varying the predetermined acceleration profile above which the one or more stops are removed as obstacles to the striker mass striking the percussion primer. The varying can comprise varying a biasing force applied to the one or more stops in a direction in which the one or more stops block the striker mass from striking the percussion primer.

Still yet provided is an inertial igniter comprising: a housing having a base and containing a percussion primer; a striker mass movable within the housing; one or more movable members each having a stop for limiting movement of the striker mass in the direction of the percussion primer; and a first biasing member for biasing the striker mass towards the percussion primer; wherein the striker mass has a portion which engages a portion of the one or more movable members upon a predetermined acceleration profile to remove the stop as an obstacle of movement of the striker mass in the direction of the percussion primer thereby permitting the first biasing member to urge the striker mass against the percussion primer.

The inertial igniter can further comprise a second biasing member for applying a biasing force to the stop in a direction for limiting movement of the striker mass in the direction of the percussion primer.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION

Figure 1:
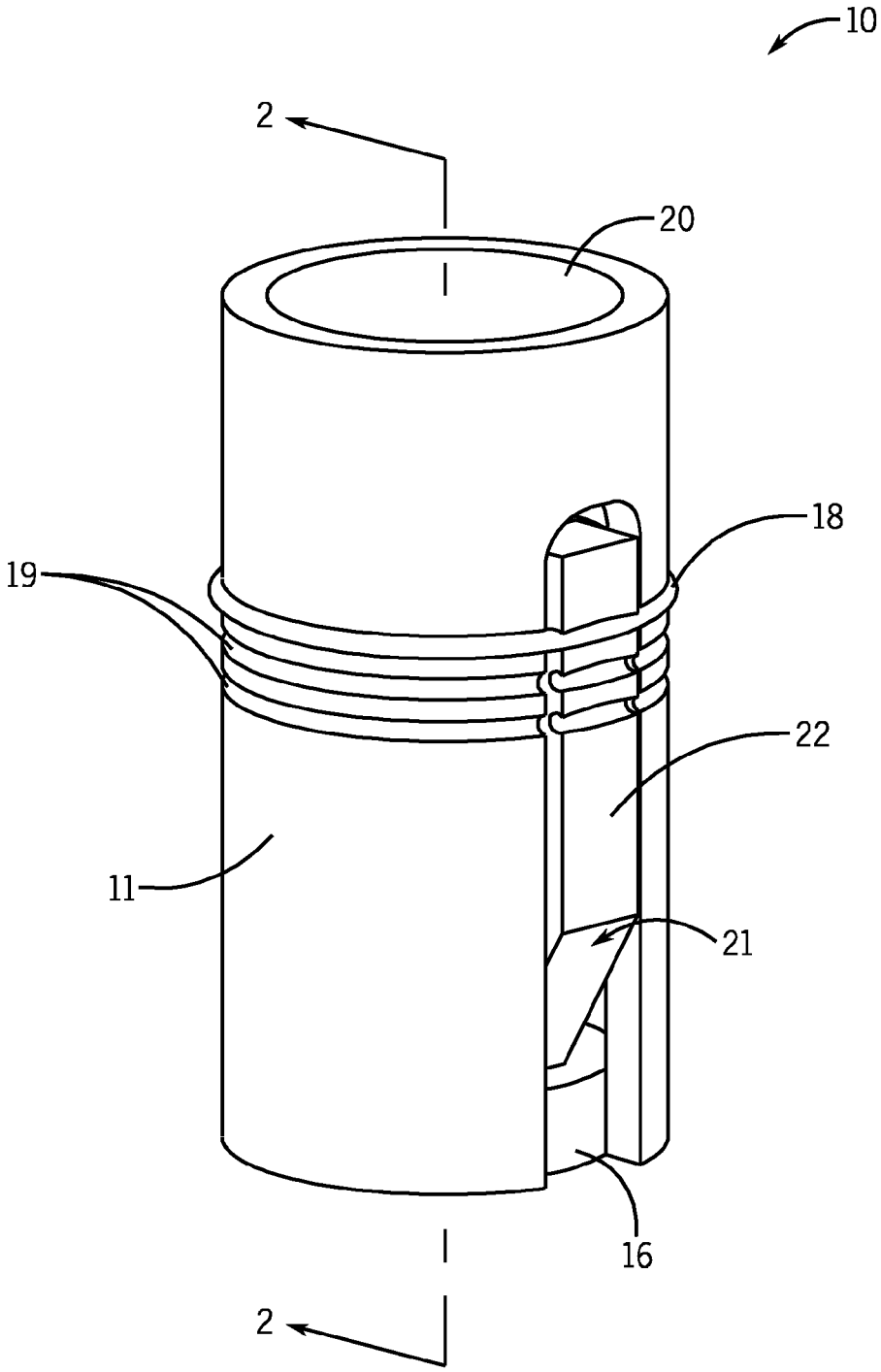
FIG. 1 illustrates an isometric view of a first embodiment of a programmable inertial igniter.

The safety mechanism can be a purely mechanical mechanism, which responds to acceleration applied to the inertial igniter. If the applied acceleration reaches or passes the designed initiation levels and if its duration is long enough, i.e., larger than any expected to be experienced as the result of accidental drops or explosions in their vicinity or other non-firing events, i.e., if the resulting impulse levels are lower than those indicating gun-firing, then the mechanism should return to its original pre-acceleration configuration, and the pyrotechnics component of the igniter is not initiated. Otherwise, the initiation system is released to provide ignition of the pyrotechnics. For example, the design requirements for actuation for one application are summarized as:

1. The device must fire when given a [square] pulse acceleration of 900 G±150 G for 15 ms in the setback direction.
2. The device must not fire when given a [square] pulse acceleration of 2000 G for 0.5 ms in any direction.
3. The device must not actuate when given a ½-sine pulse acceleration of 490 G (peak) with a maximum duration of 4 ms.
4. The device must be able to survive an acceleration of 16,000 G, and preferably be able to survive acceleration of over 50,000 G.

Inertia-based igniters can therefore comprise two components so that together they provide the aforementioned mechanical safety and to provide the required striking action to achieve ignition of the pyrotechnic elements. The function of the safety system is to prevent the striker mechanism to initiate the pyrotechnic under any of the accidental acceleration profiles that the inertial igniter may experience. The safety system can then fully actuate or release the striker and allow it to initiate the igniter pyrotechnics when acceleration profiles corresponding to the all-fire requirements are experienced. The ignition itself can take place as a result of striker impact, or simply contact or proximity or a rubbing action. For example, the striker may be akin to a firing pin and the target akin to a standard percussion cap primer. Alternately, the striker-target pair may bring together one or more chemical compounds whose combination with or without impact or a rubbing will set off a reaction resulting in the desired ignition.

When all-fire requirements are experienced, the safety system can allow the ignition process to proceed. The igniter pyrotechnics may be ignited mechanically using the following basic mechanisms:

1. Once the all-fire acceleration level and time duration requirements have been satisfied, the striker element can be released and accelerated toward its target under the influence of the remaining portion of the specified all-fire acceleration time profile to affect ignition of the pyrotechnics in one of the aforementioned manners.
2. Once the all-fire acceleration level and time duration requirements have been satisfied, the striker element is released and accelerated toward its target under the influence of certain spring (elastic elements) force to affect ignition of the pyrotechnics in one of the aforementioned manners. For added safety, the spring (elastic elements) may be preloaded substantially due to the firing acceleration profile. In these mechanisms, the striker element acceleration towards its target by the preloaded spring (elastic element) can be prevented by certain "stopping element" until the all-fire acceleration level and time duration requirements have been satisfied.
3. Once the all-fire acceleration level and time duration requirements have been satisfied, the striker element or system can cause certain "stopping element(s)" that prevent the striker to initiate ignition to be removed or made ineffective, thereby upon the cessation of the firing acceleration, the striker can be accelerated toward its target under the influence of certain spring (elastic element) force and affect ignition of the pyrotechnics in one of the aforementioned manners. In such a mechanism, the spring (elastic element) can be preloaded substantially due to the firing acceleration profile, thereby providing added safety to the inertial igniter.

The first two of the above mechanical methods of initiating ignition are know in the art, e.g., in U.S. patent application Ser. No. 11/599,878, filed on Nov. 15, 2006, the contents of which are incorporated herein by reference. The method and related embodiments of the present invention work based on the above third mechanism of operation.

Thus, methods of allowing striker action to ignite the pyrotechnics component of an inertial igniter once the all-fire acceleration level and time duration requirements have been satisfied are provided herein. Also disclosed are a number of inertial igniter embodiments that combine such mechanisms (safety systems) with impact or rubbing or contact based initiation systems. A method is also provided that can be used to make such inertial igniters programmable, in the sense that a single inertial igniter of the present type could be readily "programmed" to operate at different all-fire acceleration levels. This capability is of utmost economical importance since it eliminates the need to produce a wide variety of inertial igniters for the present wide varieties of munitions.

It is also appreciated that all inertial igniters that are developed based on the above first two methods known in the art are initiated or have the initiation process started while the munitions round is inside the gun barrel. The inertial igniters based on the present methods, however, can be initiated after the munitions round has exited the barrel and the firing acceleration has ceased. This characteristic provides the inertial igniters with a higher level of safety for certain munitions applications. This characteristic also allows the thermal battery to withstand higher firing acceleration levels since the thermal battery chemicals stay fully solid during the entire period of firing, during which state they can generally withstand significantly higher acceleration levels than they could while in the molten and liquid state.

The inertial igniters disclosed herein can be scalable to thermal batteries of various sizes, in particular to miniaturized igniters for small size thermal batteries. Such inertial igniters must in general be safe and in particular they should not initiate if dropped, e.g., from up to 7 feet onto a concrete floor for certain applications; should withstand high firing accelerations, for example up to and in certain cases over 20-50,000 Gs; and should be able to be designed to ignite at specified acceleration levels when subjected to such accelerations longer than certain specified amount of time to match the firing acceleration experienced in a gun barrel as compared to high G accelerations experienced during accidental falls which last over very short periods of time, for example accelerations of the order of 1000 Gs when applied for 5 msec as experienced in a gun as compared to for example 2000 G acceleration levels experienced during accidental fall over a concrete floor but which may last only 0.5 msec. Reliability is also of much concern since the rounds should have a shelf life of up to 20 years and could generally be stored at temperatures of sometimes in the range of −65 to 165 degrees F. The inertial igniters must also consider the manufacturing costs and simplicity in design to make them cost effective for munitions applications.

To ensure safety and reliability, inertial igniters should not initiate during acceleration events which may occur during manufacture, assembly, handling, transport, accidental drops, or other similar accidental events. Additionally, once under the influence of an acceleration profile particular to the firing of ordinance from a gun, the device should initiate with high reliability. In many applications, these two requirements often compete with respect to acceleration magnitude, but differ greatly in impulse. For example, an accidental drop may well cause very high acceleration levels—even in some cases higher than the firing of a shell from a gun. However, the duration of this accidental acceleration will be short, thereby subjecting the inertial igniter to significantly lower resulting impulse levels. It is also conceivable that the igniter will experience incidental low but long-duration accelerations, whether accidental or as part of normal handling, which must be guarded against initiation. Again, the impulse given to the miniature inertial igniter will have a great disparity with that given by the initiation acceleration profile because the magnitude of the incidental long-duration acceleration will be quite low.

Figure 2:
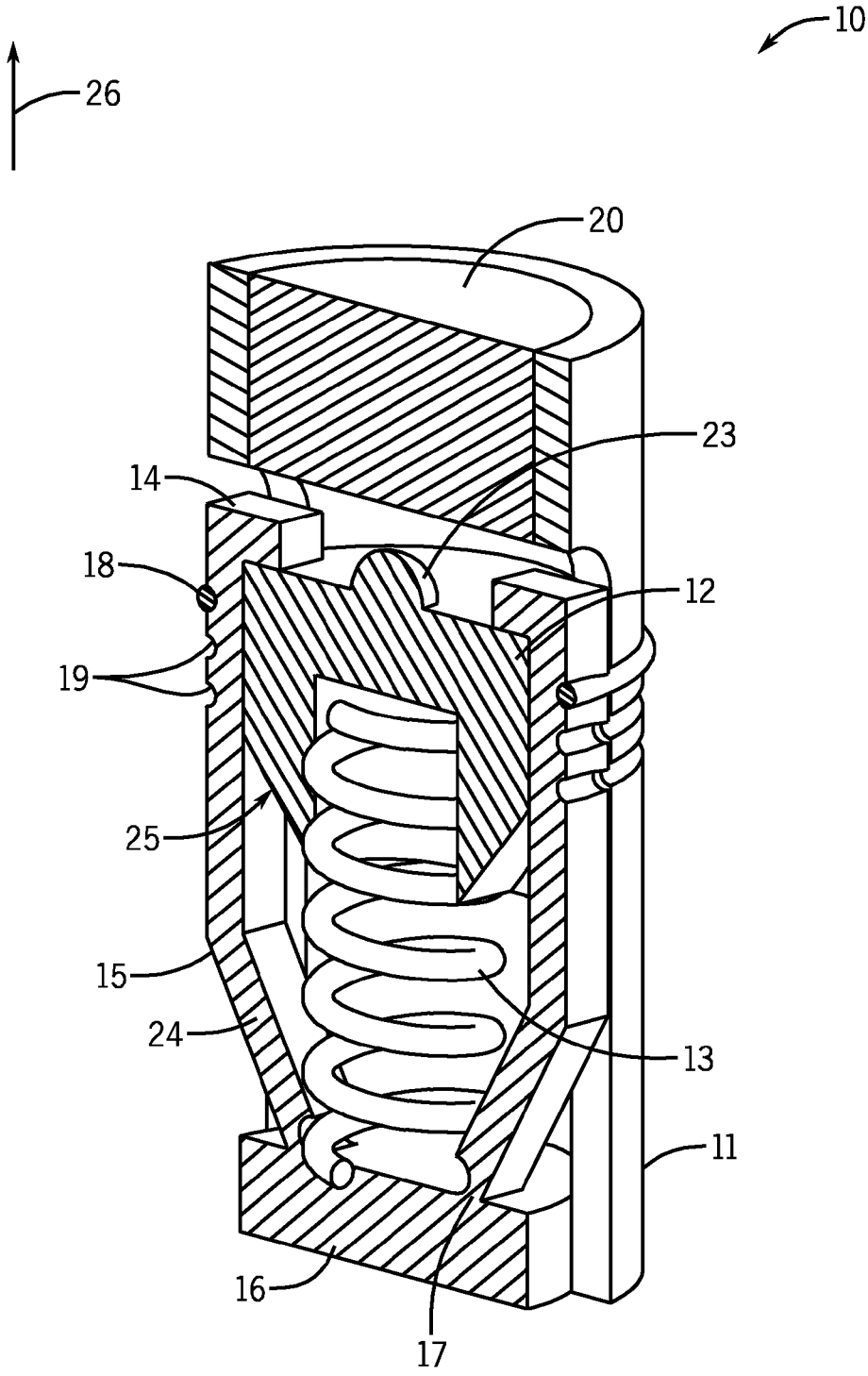
FIG. 2 illustrates a sectional view of the programmable inertial igniter of FIG. 1 as taken along line 2-2 in FIG. 1.

A schematic of a "programmable" inertial igniter embodiment 10 is shown in FIG. 1. The cutaway drawing of the igniter is shown in FIG. 2, in which all the interior components of the inertial igniter 10 can be observed. The inertial igniter has a housing 11, on both sides of which open sections 21, covering a portion of the length of the housing 11, are provided. The bottom side of the housing 11 is open and through this opening, the striker assembly 22 with base 16 is assembled into the body of the housing 11. The base 16 of the striker housing 22 can be pressed into the housing 11 cavity against a stop step (not shown) for ease of assembly or otherwise secured to the housing 11. A striker mass 12 can be cylindrical, with a slightly smaller outside diameter than the inside diameter of the housing 11 for ease of longitudinal travel within the housing 11. The upward travel of the striker 12 is limited by at least one stop 14, provided at the end of a link 15, which is attached to the top of the base 16 with a pin joint 17, which allows outward rotation of the link 15. The pin joint 17 can be a living joint and an integral part of the base 16. In an embodiment, at least two such links 15 are provided, one on each side of the striker mass 12. The link(s) 15 are prevented from opening (i.e., rotating outward, towards the outside of the housing 11) by ring-type springs 18 (similar to commonly used retaining rings), which are seated in grooves 19, provided on the outer surface of the housing 11 as well corresponding outer surfaces of the links 15 as can be seen in FIGS. 1 and 2. It is noted that three grooves 19 are illustrated in FIGS. 1 and 2, and a ring-type ring 18 is seen to be mounted in the upper groove.

The striker mass 12 can be biased upward against the stops 14 by preloaded spring 13. A percussion primer 20 can be firmly mounted on the top of the igniter housing 11, above the top surface of the striker mass 11. The top surface of the striker mass can be provided with a protruding part 23, which is designed to initiate the primer 20 upon impacting the primer with appropriate amount of impact velocity.

The inertial igniter 10 can operate as follows. At rest, the pre-loaded striker mass 12 is prevented from engaging the primer 20 by the stops 14. The stops 14 are designed to move outward, out of the way of the striker mass 12 by the outward rotation of the arms 15 about the joint 17. The arms 15 are, however, biased inwards by the ring-type springs 18. This configuration of the inertial igniter 10 is shown in the schematics of FIGS. 1 and 2.

Figure 3:
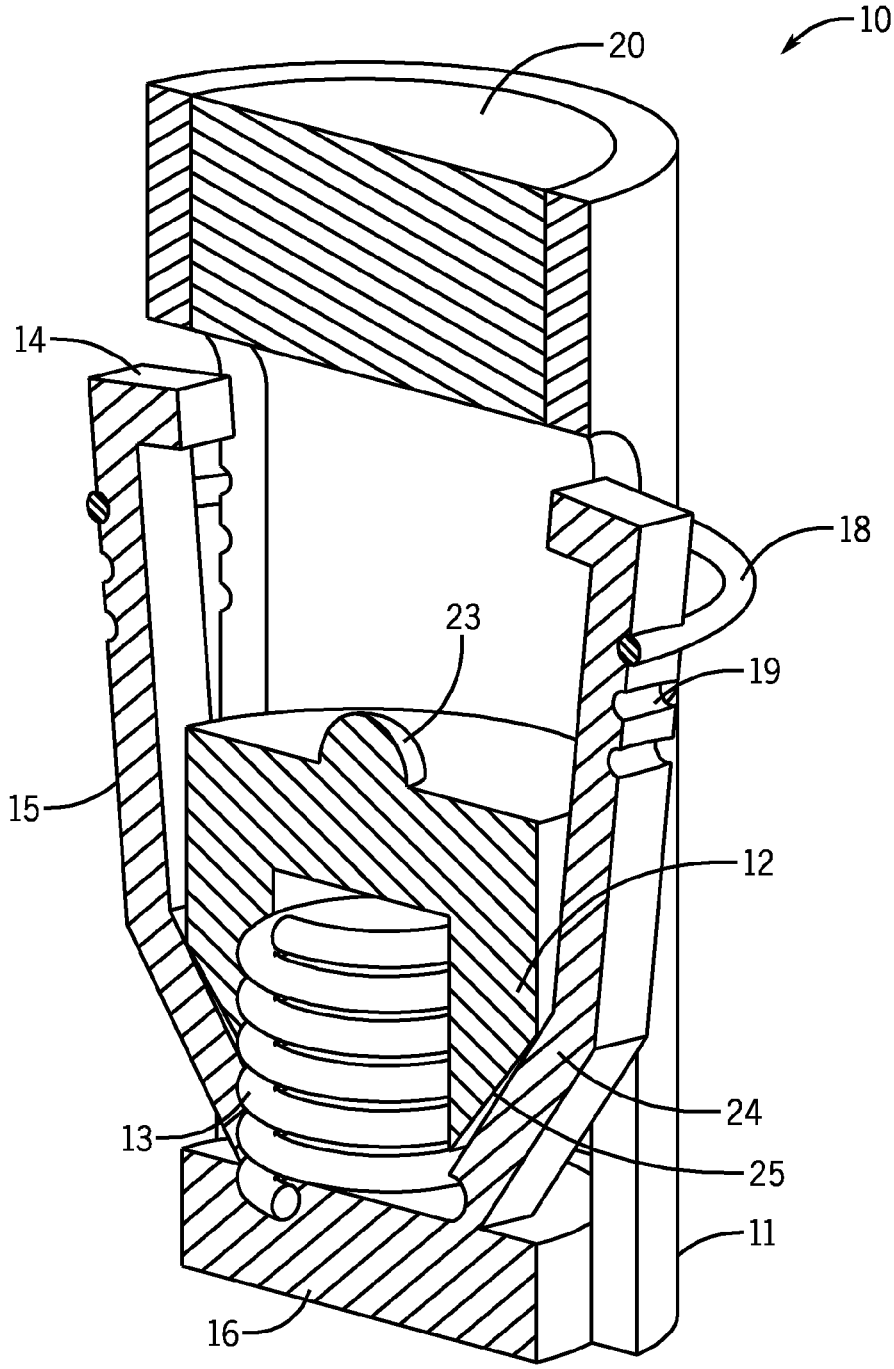
FIG. 3 illustrates the programmable inertial igniter of FIG. 2 shown after experiencing an initial acceleration.

Based on the mass of the striker 12 and on the preload of the striker spring 13, an all-fire acceleration profile in the direction of the arrow 26 will cause a net force on the striker 12 that would drive it downwards. The device can be tuned such that the all-fire acceleration will impart enough force on the striker 12 to rotate the links 15 outward after overcoming the resisting force of the ring-type springs 18 and by plastically deforming the flexural living joint 17. The striker mass 17 applies a force to the links 15 by pushing against the sloped surface 24 of the link 15 by its cone shaped bottom surface 25, as shown in FIG. 3, thereby plastically deforming the links 15 and the springs 18 in the position shown in FIG. 3. Alternatively, the links can break and/or the springs can break or release from the grooves so that the stops 14 do not act as an obstacle for the striker mass 12 to strike the percussion primer 20. For acceleration profiles which do not fire the inertial igniter 10 (e.g., accidental dropping), the links 15 and spring 18 elastically deform and return the links to the position shown in FIG. 2.

As the all-fire acceleration wanes towards conclusion, the reaction force on the striker 12 will diminish to a point at which it is lower than the striker spring 13 force. At this point, the striker spring will drive the striker upwards toward the primer or other provided pyrotechnic elements.

Figure 4:
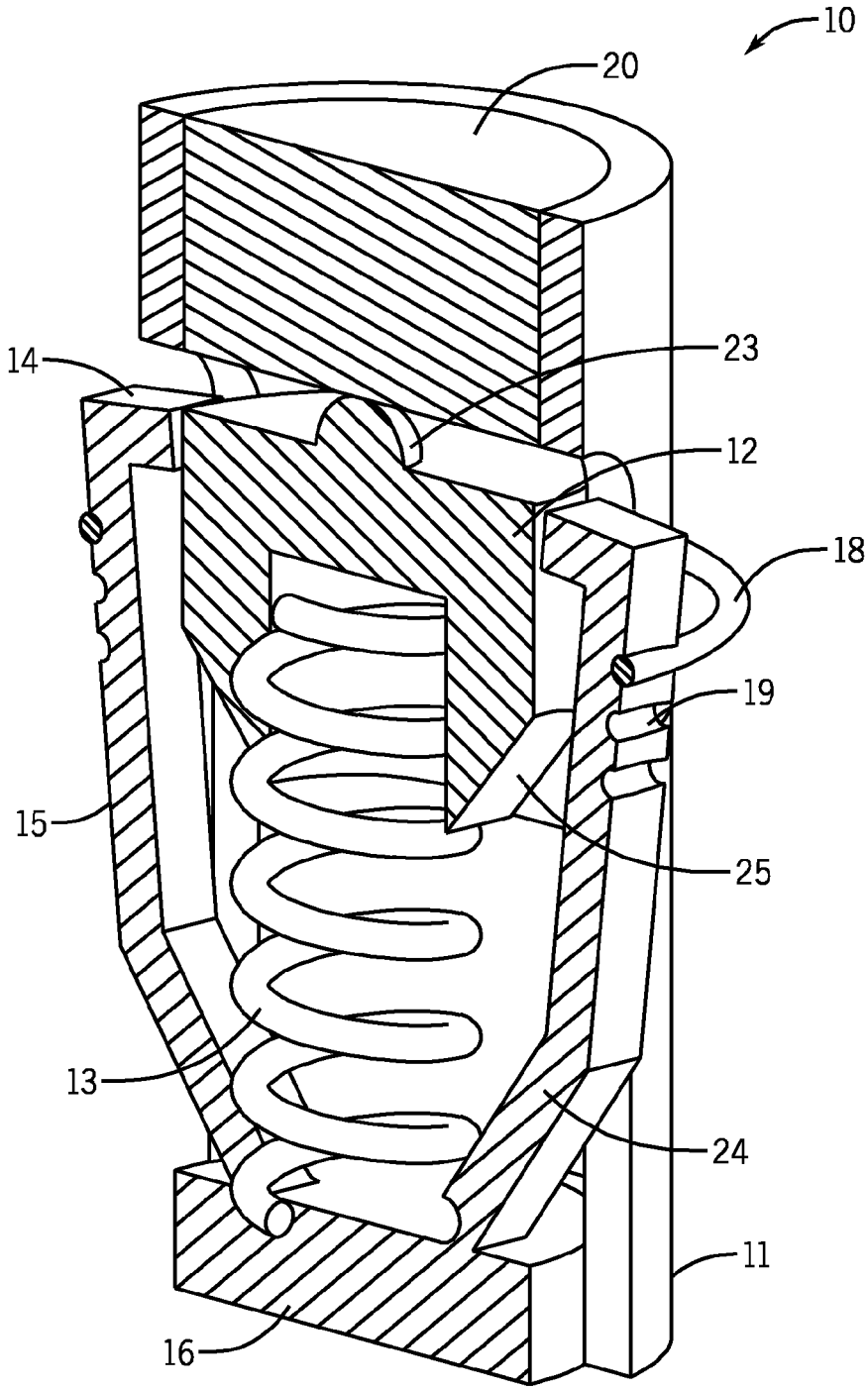
FIG. 4 illustrates the programmable inertial igniter of FIG. 2 shown after the initial acceleration has passed and the percussion primer is activated.

Because the safety stops 14 have been displaced out of the path of the striker mass 12 during the firing acceleration peak, the striker 12 is free to pass beyond its rest position and impact the primer 20 (or any other one part or two part pyrotechnics), initiating the igniter. This is shown in FIG. 4.

If the experienced acceleration profile imparts less impulse to the device than the specified all-fire acceleration, the striker 12 will not impact the tapered portion 24 of the link 15 with enough energy and does not provide enough force to rotate the links 15 outward and move the stops 14 out of the path of the striker mass 12. The striker 15 would therefore return to engage the stops 14 in its upper rest position. Clearly, the device may be partially actuated time and time again without effecting its later operation under the influence of an all-fire acceleration.

Such inertial igniter mechanisms provide for a very high degree of safety because the striker is actuated in a direction opposite to the direction of the reaction force (i.e., the direction of the force acting on the striker mass 12 due to the firing acceleration in the direction of the arrow 26) that all the components of the device experience during firing. The inertial igniters developed based on the present method, therefore, are initiated after the munitions round has exited the barrel and that the firing acceleration has substantially ceased.

The disclosed inertial igniter in this invention is highly programmable for use in gun-fired and mortar munitions. This is the case since for almost all such applications; all no-fire safety requirements can be satisfied by the provision of appropriate number of ring-type springs 18 with appropriate spring rate characteristics. As a result, one inertial igniter can be fabricated that would satisfy almost any no-fire and all-fire requirements by just providing appropriate ring-type springs 18, which are added external to the otherwise assembled inertial igniter. One type ring-type spring 18 can be used in a variety of grooves 19 to differ the acceleration profile. Further, different spring elements can be used and different or the same spring elements can be used in more than one of the grooves.

In addition, such inertial igniters may be programmed for a minimum initiation acceleration profile, and yet be used in applications where it will experience a much greater impulse without a loss in safety no-fire characteristics. It is also noted that with all firing profiles that are required to initiate the device, the striker mass 12 stays in its lower position as shown in FIG. 3, until the peak of the acceleration profile has passed.

To make such an assembly process even easier, the inertial igniter could be first assembled with either the weakest ever required ring-type spring 18, with the required additions once the requirements have been identified. Alternatively, the assembled device may be held together by providing some temporary element such as a rubber band or a paper or cardboard ring or tube. Alternatively, once the appropriate one or more ring-type springs 18 have been assembled onto the inertial igniter 10, the entire assembly is packaged inside a housing and preferably sealed to keep out contaminants and thereby increase the reliability of the device and its shelf life.

It is noted that such inertial igniters have the added advantage of providing a high degree of initiation safety in the sense that the spring element 12 that actuates the striker mass 12 is not preloaded while the device is at rest; therefore there is no possibility of accidental ignition.

However, if shelf life and/or performance precision are not an issue, friction and/or viscous damping element(s) of some kind may be used together with the spring element 13 (preferably in parallel with the spring element 13, FIG. 2, not shown) to slow down the motion of one inertial elements, thereby helping to reduce the required length of travel of the striker mass 12, i.e., help to reduce the height of the inertial igniter. The dry friction elements (such as braking elements) are well known in the art. Viscous damping elements operating based on fluid or gaseous flow through orifices of some kind or a number of other designs using the fluid or gas viscosity, or the use of viscoelastic (elastomers and polymers of various kind and designs) are also well known in the art.

However, the use of any of the aforementioned viscous damping elements has several practical problems for use in inertial igniters for thermal batteries that are to be used in munitions. Firstly, to generate a significant amount of damping force to oppose the acceleration generated forces, the inertial element must have gained a significant amount of velocity since damping force is proportional to the attained velocity of the inertial element. This means that the element must have traveled long enough time and distance to attain a high enough velocity, thereby resulting in too long igniters. Secondly, fluid or gaseous based damping elements and viscoelastic elements that could be used to provide enough damping to achieve a significant amount of delay time cannot usually provide the desired shelf life of up to 20 years as required for most munitions.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An inertial igniter comprising:

a housing;

a striker mass movable relative to the housing;

a biasing element for biasing the striker mass towards a percussion primer;

one or more movable members each having one or more stops, the one or more stops having a first position for preventing a portion of the striker mass from striking the percussion primer and a second position allowing the portion of the striker mass to strike the percussion primer;

wherein the striker mass is configured to move during acceleration of the housing to both load the biasing element and move the one or more stops to the second position, such that the striker mass is moved by the biasing element during a set forward period to strike the percussion primer.

2. The inertial igniter of claim 1, wherein the striker mass, biasing element and one or more movable members are configured as a sub-assembly contained within the housing.

3. The inertial igniter of claim 2, wherein the housing includes a cut-out portion corresponding to each of the one or more movable members and the one or more movable members move into the cut-out portion when the one or more stops assume the second position.

4. The inertial igniter of claim 1, wherein the portion of the striker mass that strikes the percussion primer is a protrusion from a surface of the striker mass.

5. The inertial igniter of claim 1, wherein the biasing member is a compression spring.

6. The inertial igniter of claim 1, wherein the one or more movable members are pivotal about a pivot relative to a base member.

7. The inertial igniter of claim 6, wherein the pivot is a living hinge which is plastically deformed upon being subjected to the acceleration.

8. The inertial igniter of claim 6, wherein the one or more stops are positioned at an end of the movable member opposite from the pivot.

9. The inertial igniter of claim 1, wherein the striker mass has a portion which engages a portion of the one or more arms when subjected to the acceleration to urge the one or more stops into the second portion.

10. The inertial igniter of claim 1, further comprising a programming means for varying the acceleration at which the sticker mass strikes the percussion primer.

11. The inertial igniter of claim 10, wherein the programming means comprises one or more programming biasing members.

12. The inertial igniter of claim 11, wherein the one or more programming biasing members comprise one or more spring bands.

13. The inertial igniter of claim 12, wherein the housing comprises one or more grooves for accommodating the one or more spring bands.

14. The inertial igniter of claim 13, wherein the one or more grooves comprises a plurality of grooves each at a different location on the housing.

15. The inertial igniter of claim 12, wherein the one or more spring bands are one of plastically deformed, broken or released upon being subjected to the acceleration.

16. A method for striking a percussion primer upon a predetermined acceleration profile, the method comprising:

blocking a striker mass from striking the percussion primer with one or more stops when an applied acceleration and duration is less than the predetermined acceleration profile;

moving the striker mass when the applied acceleration and duration is greater than the predetermined acceleration profile to both load a biasing element during the applied acceleration and remove the one or more stops as an obstacle to the striker mass striking the percussion primer; and moving the striker mass by the biasing element during a set forward period to strike the percussion primer.

17. The method of claim 16, wherein the removing of the one or more stops as an obstacle to the striker mass striking the percussion primer comprises deforming a movable member which holds the one or more stops when the applied acceleration and duration is greater than the predetermined acceleration profile.

18. The method of claim 16, further comprising varying the predetermined acceleration profile above which the one or more stops are removed as obstacles to the striker mass striking the percussion primer.

19. The method of claim 18, wherein the varying comprises varying a biasing force applied to the one or more stops in a direction in which the one or more stops block the striker mass from striking the percussion primer.

20. An inertial igniter comprising:

a housing having a base and containing a percussion primer;

a striker mass movable within the housing;

one or more movable members each having a stop for limiting movement of the striker mass in the direction of the percussion primer; and a first biasing member for biasing the striker mass towards the percussion primer;

wherein the striker mass has a portion which engages a portion of the one or more movable members upon a predetermined acceleration profile to remove the stop as an obstacle of movement of the striker mass in the direction of the percussion primer thereby permitting the first biasing member to urge the striker mass against the percussion primer during a set forward period.

21. The inertial igniter of claim 20, further comprising a second biasing member for applying a biasing force to the stop in a direction for limiting movement of the striker mass in the direction of the percussion primer.

* * * * *